US006578541B2

(12) United States Patent
Stromsky et al.

(10) Patent No.: US 6,578,541 B2
(45) Date of Patent: Jun. 17, 2003

(54) INTERNAL-COMBUSTION ENGINE, IN PARTICULAR FOR MOTORCYCLES

(75) Inventors: Roland Stromsky, Freiberg (DE); Albrecht Reustle, Walheim (DE)

(73) Assignee: Harley-Davidson Motor Company Group, Inc., Milwaukee, WI (US)

( * ) Notice: Subject to any disclaimer, the term of this patent is extended or adjusted under 35 U.S.C. 154(b) by 0 days.

(21) Appl. No.: 09/883,104

(22) Filed: Jun. 15, 2001

(65) Prior Publication Data

US 2002/0020385 A1 Feb. 21, 2002

(30) Foreign Application Priority Data

Jun. 16, 2000 (DE) ..... 100 29 844

(51) Int. Cl.[7] ..... F01M 11/06
(52) U.S. Cl. ..... 123/196 R
(58) Field of Search ..... 123/196 R

(56) References Cited

U.S. PATENT DOCUMENTS

| | | | | |
|---|---|---|---|---|
| 2,118,283 A | | 5/1938 | Winslow et al. | |
| 4,446,828 A | | 5/1984 | Bauder et al. | |
| 4,915,070 A | | 4/1990 | Okui | |
| 5,467,843 A | * | 11/1995 | Esch et al. | 123/196 R |
| 5,493,952 A | * | 2/1996 | Daniel et al. | 123/196 R |
| 5,769,047 A | * | 6/1998 | Zoche | 123/196 R |
| 5,960,763 A | * | 10/1999 | Yamamura | 123/196 R |
| 6,202,621 B1 | * | 3/2001 | Inumaru et al. | 123/196 R |
| 6,343,584 B1 | * | 2/2002 | Kudou et al. | 123/196 R |

FOREIGN PATENT DOCUMENTS

| | | |
|---|---|---|
| DE | 2230000 | 1/1974 |
| DE | 3142669 A1 | 11/1982 |
| DE | 3711792 A1 | 10/1987 |
| DE | 4102588 C2 | 7/1993 |

* cited by examiner

*Primary Examiner*—Paul J. Hirsch
(74) *Attorney, Agent, or Firm*—Michael Best & Friedrich LLP

(57) ABSTRACT

The invention relates to an internal-combustion engine, in particular for a motorcycle. The motorcycle engine preferably includes a crankshaft rotatable about an axis, a web coupled to the crankshaft, and curved wall portions surrounding the crankshaft. The web has an outer surface which defines a substantially circular pathway as it rotates about the axis. Oil is preferably flung from the web and the crankshaft into an oil channel which has a longitudinal axis that is substantially tangential to an adjacent portion of the pathway. Additionally, oil which is flung from the web and the crankshaft onto the curved wall portions drains into the oil channel, which leads to an oil-storage tank. Preferably, the housing also includes a balancing shaft with a balancing web rotatable about a second axis, additional curved wall portions surrounding the balancing shaft and the balancing web, and a second oil channel. The balancing web has a balancing web outer surface that rotates along a substantially circular pathway. The second oil channel has a longitudinal axis that is substantially tangential to an adjacent portion of the second pathway. Oil thrown from the balancing shaft is flung into a second oil channel, which leads to the oil-storage tank.

18 Claims, 1 Drawing Sheet

INTERNAL-COMBUSTION ENGINE, IN PARTICULAR FOR MOTORCYCLES

FIELD OF THE INVENTION

This invention relates to an oil collection apparatus for an internal-combustion engine and a method of removing oil from an internal combustion engine, in particular for a motorcycle.

BACKGROUND OF THE INVENTION

In the case of internal-combustion engines, it is known to design the oil-storage tank as a so-called dry-sump lubrication in a structural space separate from the crankcase. For example, U.S. Pat. No. 4,915,070 discloses integrating an oil tank in the crankcase of an internal-combustion engine. The oil-supply, often supplied by oil channels, can likewise be arranged in the crankcase, so that the entire lubricating-oil supply of the internal-combustion engine is housed in a space-saving manner in the internal-combustion engine.

In the case of dry-sump lubrication, it is necessary for the lubricating oil arriving from the consumer devices to be conveyed by way of an oil-suction pump into the oil tank, from where it is pumped once more to the consumer devices with the aid of an oil-conveying pump. For a continuous and reliable lubricating-oil supply, it is necessary for the lubricating oil to be brought rapidly back from the crankcase to the oil-storage tank.

SUMMARY

The present invention provides an improved motorcycle engine having a crankshaft rotatable about an axis, a crankcase housing surrounding the crankshaft, a web coupled for rotation about the crankshaft along a circular pathway, and an oil channel having a longitudinal axis that is substantially tangential to an adjacent portion of the pathway. Preferably, the motorcycle engine includes two cylinders in a V-shaped configuration. In alternative embodiments of the present invention, the engine may have any number of cylinders including one, two, three, or four. Similarly, the engine may have any number of webs for balancing the rotation of the crankshaft.

In one aspect of the present invention, the crankshaft and the web fling oil and an oil/air mixture at the walls of the crankcase housing as the crankshaft and the webs rotate about their axis. The outer surface of the web rotates in a substantially circular pathway. An oil channel is preferably located substantially tangential to the circular pathway. Because the oil channel extends partially tangentially away from the crankshaft and the web, the oil channel is able to rapidly separate the oil from the oil/air mixture and rapidly evacuate the oil from the crankcase. Preferably, a substantial amount of oil is flung directly into the oil channel and is therefore removed from the crankcase by the oil channel to an oil pump.

The remaining oil is preferably flung against the housing wall which is preferably contoured to drain the oil toward the oil channel. Most preferably, the crankcase has a first and a second curved wall portion which are contoured to encircle the web as the web rotates along its circular pathway. This substantially curved configuration helps to direct the oil away from the crankshaft and into the oil channel. Oil loss is minimized because the web flings a substantial quantity of oil directly into the oil channel. The reduction in oil loss and the rapid return of the lubricating oil allows for the output of the oil pumps to be set correspondingly lower.

A balancing shaft is commonly provided in engines of this type to balance the mass forces caused by the rotation of the crankshaft and the web about the axis. The balancing shaft is preferably parallel to the crankshaft and preferably has a balancing shaft web.

In another aspect of the present invention, the balancing shaft is surrounded by curved wall portions of the crankcase, between which an oil channel extends partially tangentially with respect to the rotational axis of the balancing shaft. Oil is preferably flung from the balancing shaft and the balancing shaft web. The second oil channel preferably collects the oil that is flung from the balancing shaft and the balancing shaft web. Additionally, the oil that is not flung directly into the second oil channel drains down the walls of the crankcase housing into the second oil channel. In this way the lubricating oil can be conveyed in a deliberate manner to the intake socket of the oil-suction pump by the rotation of the balancing shaft or the balancing shaft web.

In addition to the rapid return of the lubricating oil to the oil-storage tank, foam suppression of the lubricating oil is desired before the latter returns to the oil tank. Therefore, an oil/air separator is provided, to which the two oil channels preferably lead. The oil is removed from the crankcase by the oil channels and is fed into the oil pump via the oil/air separator. In this manner the air is separated from the oil/air mix by the separator before the oil reaches the oil pump.

In still another aspect of the present invention, the oil-storage tank is advantageously integrated in the crankcase below or to one side of the partitioned-off crank space. Further advantageous embodiments and improvements of the oil collection apparatus and method of collecting oil according to the invention for an internal-combustion engine are described below.

BRIEF DESCRIPTION OF THE DRAWING

The present invention is further described with reference to the accompanying drawing, which shows a preferred embodiment of the present invention. However, it should be noted that the invention as disclosed in the accompanying drawing is illustrated by way of example only. The various elements and combinations of elements described below and illustrated in the drawing can be arranged and organized differently to result in embodiments which are still within the spirit and scope of the present invention.

In the drawing, wherein like reference numerals indicate like parts.

DETAILED DESCRIPTION OF THE ILLUSTRATED EMBODIMENTS

Figure 1:
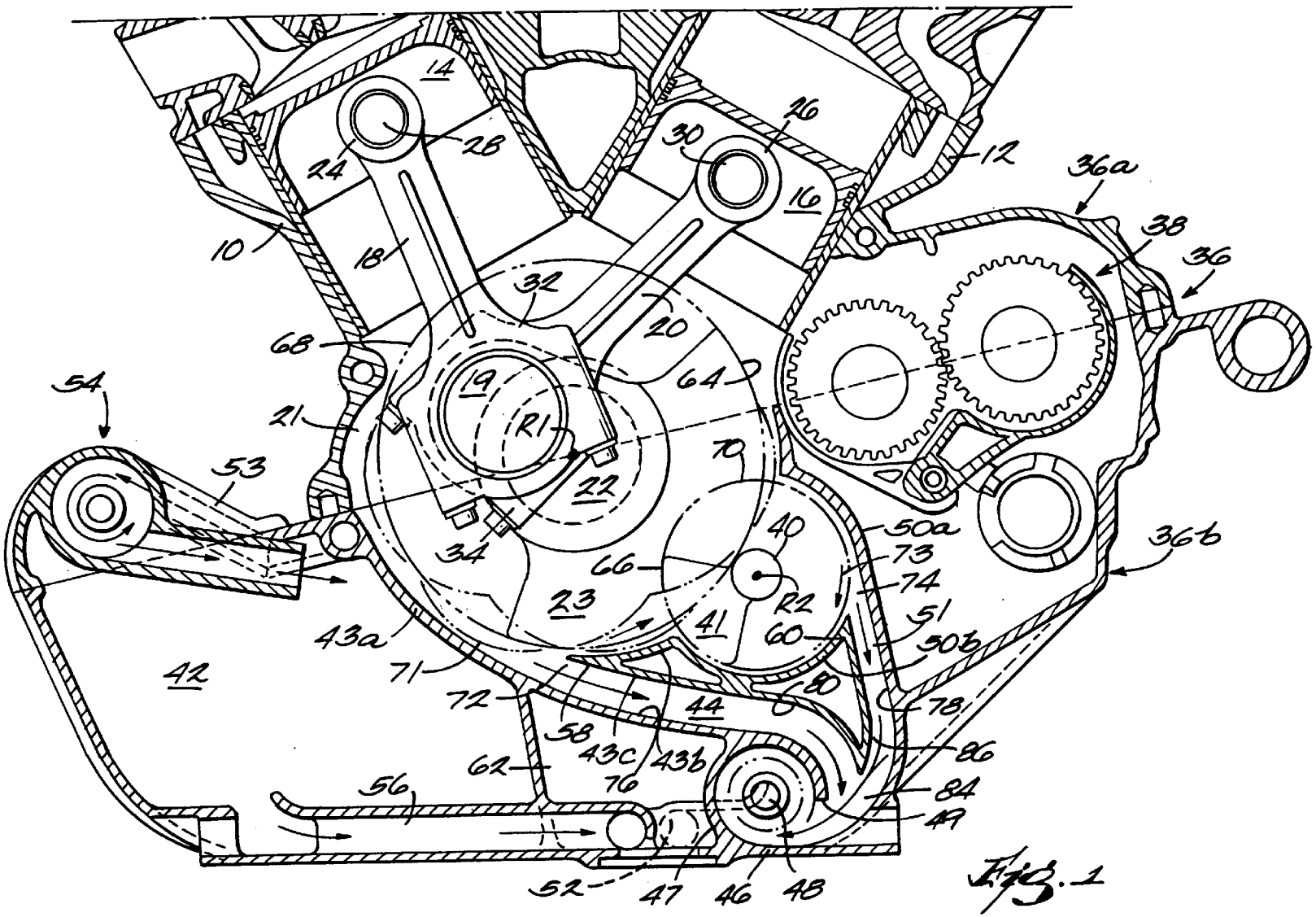
FIG. 1 is a side section view of an internal-combustion engine embodying the present invention.

The present invention is described herein as including a four-stroke two-cylinder engine. However, the present invention can be used with almost any number of cylinders, such as one, two, three, and six cylinder engines with equal effectiveness. Similarly, the present invention can be used with two stroke engines. Finally, reference is made to engines having a V-shape. One having ordinary skill in the art will appreciate that the present invention can be used with V-shaped engines and with in-line or straight engines with equal effectiveness. As such, the present invention can include embodiments in which the configuration of the engine includes any conventional motorcycle engine and is not limited to the embodiments referred to herein. For simplicity only, the following description will continue to refer to four-stroke two cylinder engines.

A four-stroke engine, the two cylinders 10, 12 of which are arranged in a V-shape with respect to each other, is illustrated in FIG. 1. The pistons 14, 16, arranged in the cylinder chambers, drive a crankshaft 22 arranged in a crank space 21, by way of two connecting rods 18, 20, the two small ends 24, 26 of the connecting rods being connected to the two piston pins 28, 30 and the two big ends 32, 34 of the connecting rods being connected to a common journal 19 of the crankshaft 22. In order to compensate the mass forces, the crankshaft journal 19 is bounded by two crankshaft webs 23, only one of which is visible in FIG. 1. In alternative embodiments of the present invention, a single web 23 can be mounted on the crankshaft with equal effectiveness.

In addition, a gearing unit 38, a balancing shaft 40 with a balancing web 41 for compensating the mass forces, and a lubricating-oil supply system (to be described in greater detail below) are mounted in the crankcase 36. The crankcase 36 is constructed in two parts and comprises an upper crankcase half 36*a* and a lower crankcase half 36*b*.

An oil tank 42 is arranged in the lower crankcase half 36*b*. The oil tank 42 is partitioned off from the crank space 21 and is constructed as an oil reservoir and to which the lubricating oil present in the crank space 21 and in the gearing unit 38 is supplied with the aid of an oil-suction pump (not shown). The lubricating oil is conveyed with the aid of an oil-conveying pump (not shown) from the oil tank 42 to the consumer devices, such as for example the camshaft bearings, the cylinder running surfaces, the crankshaft bearings, and the like, before it is pumped into the oil tank 42 again by way of the oil-suction pump (not shown).

The crankshaft 22 rotates about a first axis of rotation R1. The crankshaft web 23 is coupled to the crankshaft 22 and rotates the crankshaft web 23 along a first circular pathway 68 within the crankcase 21. The crankshaft web 23 has an outer surface 64 that is preferably arcuately shaped but may be any other shape.

The first circular path 68 is surrounded by a first and a second curved wall portion 43*a* and 43*b*, respectively. In other embodiments of the present invention, a single curved wall portion 43*a* may be used with equal effectiveness. The first and second curved wall portions 43*a*, 43*b* are spaced from the first pathway 68, the crankshaft webs 23, and the big ends 32, 34 of the connecting rods so that the big ends 32, 34 and the crankshaft webs 23 do not contact the first and second curved wall portions 43*a*, 43*b*. In different embodiments of the present invention, the first and second curved wall portions 43*a*, 43*b* may have any radius but preferably are contoured to surround the circular pathway 68 of the web 23.

Oil flung from the web 23 or the crankshaft 22 is preferably flung into a first oil channel 44 that has a longitudinal axis (partially represented by the arrow 71) that extends substantially tangentially with respect to the first circular pathway 68 between the first curved wall portion 43*a* and the second curved wall portion 43*b*. The first oil channel inlet 72 separates the first and second curved wall portions 43*a*, 43*b*. The first oil channel 44 has a first oil channel wall 76 and a second oil channel wall 80, both of which extend from the first oil channel inlet 72 to the oil tank 42.

The first oil channel 44 leads to an oil/air separator 46 which is integrated in the lower half of the crankcase 36*b*. The oil/air separator 46, commonly called a swirl pot, has a cylindrical housing 47 in the interior of which a venting pipe 48 is arranged.

The first oil channel wall 76 is preferably an extension of the first curved wall portion 43*a* so that the oil is more easily drained from the area around the crankshaft 22 to the oil tank 42. The second curved wall portion 43*b* and the oil channel second wall 80 intersect to form a first wedge 58, which helps to direct oil flung from the crankshaft 22 and the web 23 into the first oil channel wall 76.

The first oil channel 44 is preferably contoured to follow the external contour of the cylindrical housing 47 in the region of the oil/air separator 46. The oil enters the oil/air separator 46 through an opening 49 in the structural space formed between the housing 47 and the venting pipe 48.

A balancing shaft 40 is mounted in the crankcase 21. The balancing shaft 40 preferably rotates about a second axis of rotation R2, which is preferably substantially parallel to the first axis of rotation R2 and to the crankshaft 22. A balancing web 41 is coupled to the balancing shaft 40 so that the balancing web 41 also rotates about the second axis of rotation R2. The balancing web 41 has a balancing shaft outer surface 66 that is arcuately shaped but can, in different embodiments, have any other shape. The rotation of the balancing web outer surface 66 about the second axis of rotation R2 defines a second pathway 70 that is substantially circular.

The second pathway 70 is encased within the crankcase 68 and is preferably substantially surrounded by third and fourth curved wall portions 50*a* and 50*b*, respectively, the curves of which are adapted to surround the second circular pathway 70 without interfering with the rotation of the balancing web 41. Oil flung from the balancing web 41 and the balancing shaft 40 preferably enters a second oil channel 51 through a second oil channel inlet 74. The second oil channel 51 has a longitudinal axis (partially represented by the arrow 73) that extends substantially tangentially with respect to the second circular pathway 70 between the third and fourth curved wall portions 50*a*, 50*b*.

The second oil channel 51 preferably has a first oil channel wall 86 and a second oil channel wall 78. The second oil channel wall 78 is an extension of the third curved wall portion 50*a*. The third curved wall portion 50*a* substantially directs the oil flung from the balancing shaft 40 and the balancing web 41 into the second oil shaft 51. The fourth curved wall portion 50*b* and the first oil channel wall 86 intersect to form a wedge 60, which helps to direct the oil into the second oil channel 51.

A main oil channel 84 is formed by the intersection of the first and the second oil channels 44, 51. The main oil channel 84 preferably directs the oil from the first and the second oil channels 44, 51 to downstream operations, including the first and second air/oil separators 46, 54, the oil tank 42, and the consumer devices (not shown).

The main oil channel 84 preferably opens into the oil/air separator 46 by way of the opening 49. A third oil duct 52 leads from the oil/air separator 46 to the oil-suction pump, from which a fourth oil duct 53, shown only in part, leads to a second oil/air separator 54 and from there into the oil tank 42. The second oil/air separator 54 is integrated in the oil tank 42 and is preferably identical in its structural shape to the first oil/air separator 46. The lubricating oil is supplied to the consumer devices with the aid of the oil-conveying pump (not shown) by way of a fifth oil duct 56.

When the engine is running, the lubricating oil arriving in the crank space 21 from the consumer devices is flung in a deliberate manner, in particular by the webs 23 of the crankshaft 22 and the balancing web 41 of the balancing shaft 40, into the first and second oil channels 44, 51. The wedges 58, 60 act as an oil plane so that a considerable part of the lubricating oil flung away by the crankshaft 22 and the balancing shaft 40 is separated and arrives in the first and second oil channels 44, 51.

The kinetic energy with which the lubricating oil arrives in the first and second oil channels 44, 51 is utilized at the same time for the air separation which takes place in the oil/air separator 46. In this case the air provided with the slight degree of kinetic energy is separated by way of the venting pipe 48 of the oil/air separator 46 in a known manner. The air contained in the lubricating oil can escape to the outside by way of the crankcase venting for example, while the settled foam-suppressed oil is fed back to the oil tank 42 with the aid of the oil-suction pump. The second oil/air separator 54 situated immediately in front of the oil tank 42 (as viewed in the direction of flow of the lubricating oil) ensures that the oil arrives in the oil tank 42 only with a very low air content.

In another preferred embodiment, the structural space 62 provided immediately adjacent to the oil tank 42 can be used for housing one of the two oil pumps. In this manner the engine can be configured to save space and the pumps can be located relatively closely to the crankcase and the consumer devices.

The embodiments described above and illustrated in the drawings are presented by way of example only and are not intended as a limitation upon the concepts and principles of the present invention. As such, it will be appreciated by one having ordinary skill in the art, that various changes in the elements and their configuration and arrangement are possible without departing from the spirit and scope of the present invention as set forth in the appended claims. For example, while various elements and assemblies of the present invention are described as being used with an engine having one or two webs mounted on the crankshaft, one having ordinary skill in the art will appreciate that the present invention can also be used with engines having any number of webs. As such, the functions of the various elements and assemblies of the present invention can be changed to a significant degree without departing from the spirit and scope of the present invention.

What is claimed is:

1. An internal combustion engine for a motorcycle, the engine comprising:

a crankshaft having an axis of rotation;

a web coupled to the crankshaft for rotation with the crankshaft, the web having an outer surface that defines a substantially circular pathway as the web rotates with the crankshaft;

a crankcase housing the crankshaft and having a curved wall portion spaced from the pathway and contoured to partially surround the pathway;

an oil channel having an oil channel inlet, the oil channel having a longitudinal axis that is substantially tangential to an adjacent portion of the pathway such that oil thrown by the web as the web rotates is directed into the oil channel inlet, the oil channel inlet being located on the curved wall portion;

a balancing shaft in the crankcase and having an axis of rotation substantially parallel to the axis of rotation of the crankshaft;

a balancing web on the balancing shaft, the balancing web having an outer surface that defines a second substantially circular pathway as the balancing web rotates with the balancing shaft; and a second curved wall portion in the crankcase spaced from the second pathway and contoured to partially surround the second pathway, the second curved wall portion partially defining a second oil channel with a second oil channel inlet, the second oil channel having a longitudinal axis that is substantially tangential to an adjacent portion of the second pathway such that oil thrown by the balancing we is directed into the second oil channel inlet as the balancing web rotates.

2. The internal combustion engine as claimed in claim 1, further comprising a first and a second oil channel wall defining the oil channel, the first and second oil channel walls being spaced apart.

3. The internal combustion engine as claimed in claim 2, wherein the first oil channel wall is an extension of the curved wall portion.

4. The internal combustion engine as claimed in claim 2, further comprising a second curved wall portion in the crankcase, the second curved wall portion spaced from the first curved wall portion and contoured to partially surround the pathway, and wherein the second oil channel wall and the second curved wall portion define a wedge adjacent the oil channel inlet.

5. The internal combustion engine as claimed in claim 1, further comprising an oil tank in fluid communication with the oil channel.

6. The internal combustion engine as claimed in claim 1, wherein the second oil channel includes spaced apart first and second oil channel walls.

7. The internal combustion engine as claimed in claim 6, wherein the second oil channel wall of the second oil channel is an extension of the second curved wall portion.

8. The internal combustion engine as claimed in claim 6, further comprising a third curved wall portion in the crankcase, the third curved wall portion spaced from the second pathway and contoured to partially surround the second pathway, and a wedge adjacent the second oil channel inlet, the wedge defined by the intersection of the third curved wall portion and the first oil channel wall of the second oil channel.

9. The internal combustion engine as claimed in claim 1, further comprising an oil tank in fluid communication with the second oil channel.

10. The internal combustion engine as claimed in claim 1, further comprising a main oil channel formed by the intersection of the first and second oil channels.

11. A motorcycle engine, the engine comprising:

a crankshaft having a first axis of rotation;

a crankshaft web coupled to the crankshaft for rotation with the crankshaft about the first axis of rotation, the web having an outer surface;

a balancing shaft having a second axis of rotation;

a balancing web coupled to the balancing shaft for rotation with the balancing shaft about the second axis of rotation, the balancing web having a balancing web outer surface;

a first substantially circular pathway defined by the outer surface of the crankshaft web as the crankshaft web rotates with the crankshaft;

a second substantially circular pathway defined by the outer surface of the balancing web as the balancing web rotates about the balancing shaft; and a crankcase housing the crankshaft and the balancing shaft, the crankcase having a first oil channel with a first oil channel inlet and a second oil channel with a second oil channel inlet, the first oil channel having a first longitudinal axis that is substantially tangential to an adjacent portion of the first pathway such that oil thrown by the crankshaft web as the crankshaft web rotates is directed into the first oil channel inlet, the second oil channel having a second longitudinal axis that is substantially tangential to an adjacent portion of the second pathway such that oil thrown by the balancing web as the balancing web rotates is directed into the second oil channel inlet.

12. A motorcycle engine as claimed in claim 11, further comprising a first and a second curved wall portion in the crankcase spaced from the first pathway and contoured to partially surround the first pathway, the first curved wall portion being spaced from the second curved wall portion.

13. A motorcycle engine as claimed in claim 12, further comprising an oil channel wall integral with the crankcase, the oil channel wall at least partially defining the first oil channel, and a wedge adjacent the first oil channel inlet, the wedge defined by the intersection of the oil channel wall and the second curved wall portion.

14. A motorcycle engine as claimed in claim 12, further comprising a third and a fourth curved wall portion in the crankcase spaced from the second pathway and contoured to partially surround the second pathway, the third curved wall portion being spaced from the fourth wall portion.

15. A motorcycle engine as claimed in claim 14, further comprising an oil channel first wall integral with the crankcase, the oil channel wall at least partially defining the second oil channel, and a wedge adjacent the second oil channel inlet, the wedge defined by the intersection of the third curved wall portion and the oil channel wall.

16. A method of facilitating the flow of oil from a portion of a crankcase to an oil tank, the crankcase partially defined by a first curved wall portion and a second curved wall portion and having a crankshaft rotating on an axis of rotation, a crankshaft web coupled to the crankshaft for rotation with the crankshaft, the crankshaft web having an outer surface that defines a substantially circular pathway as the crankshaft web rotates with the crankshaft, wherein the crankcase is further defined by a third curved wall portion and a fourth curved wall portion and has a balancing shaft rotating on a second axis of rotation and a balancing web coupled to the balancing shaft for rotation with the balancing shaft, the balancing web having an outer surface that defines a second substantially circular pathway as the balancing shaft rotates, the method comprising:

providing an oil channel in the crankcase, the oil channel having an inlet defined by the first curved wall portion and the second curved wall portion, and the oil channel being in fluid communication with the oil tank;

rotating the crankshaft and the crankshaft web about the axis of rotation;

throwing oil off the crankshaft and the crankshaft web, into the inlet, and into a portion of the oil channel having a longitudinal axis that is substantially tangential to an adjacent portion of the pathway;

draining the oil in the oil channel into the oil tank;

providing a second oil channel in the crankcase, the second oil channel having a second oil channel inlet defined by the third curved wall portion and the fourth curved wall portion, the second oil channel being in fluid communication with the oil tank;

rotating the balancing shaft and the balancing web about the second axis of rotation;

throwing oil off the balancing shaft and the balancing web into the second oil channel inlet and into a portion of the second oil channel having a longitudinal axis that is substantially tangential to an adjacent portion of the second pathway; and draining the oil through the second oil channel into the oil tank.

17. The method as claimed in claim 16, further comprising directing the oil thrown off the crankshaft and the crankshaft web into the oil channel inlet with a wedge formed by the second curved wall portion and an oil channel wall that partially defines the oil channel.

18. The method as claimed in claim 16, further comprising:

rotating the crankshaft and crankshaft web;

throwing a second quantity of oil from the crankshaft and the crankshaft web, the second quantity of oil contacting the first and second curved wall portions; and draining the second quantity of oil from the first and second curved wall portions into the oil channel inlet.

* * * * *